US011628449B2

(12) United States Patent
Shi et al.

(10) Patent No.: US 11,628,449 B2
(45) Date of Patent: Apr. 18, 2023

(54) INTEGRATED SEPARATOR SYSTEM AND PROCESS FOR PRECONCENTRATION AND PRETREATMENT OF A MATERIAL

(71) Applicant: THE UNIVERSITY OF QUEENSLAND, St Lucia (AU)

(72) Inventors: Fengnian Shi, St Lucia (AU); Emmanuel Manlapig, St Lucia (AU)

(73) Assignee: THE UNIVERSITY OF QUEENSLAND, St Lucia (AU)

( * ) Notice: Subject to any disclaimer, the term of this patent is extended or adjusted under 35 U.S.C. 154(b) by 332 days.

(21) Appl. No.: 16/625,309

(22) PCT Filed: Jun. 21, 2018

(86) PCT No.: PCT/AU2018/000099
§ 371 (c)(1),
(2) Date: Dec. 20, 2019

(87) PCT Pub. No.: WO2018/232438
PCT Pub. Date: Dec. 27, 2018

(65) Prior Publication Data

US 2021/0339263 A1 Nov. 4, 2021

(30) Foreign Application Priority Data

Jun. 21, 2017 (AU) ..... 2017204211

(51) Int. Cl.
*B02C 19/18* (2006.01)
*B02C 23/10* (2006.01)
(Continued)

(52) U.S. Cl.
CPC ..... *B02C 19/18* (2013.01); *B02C 23/10* (2013.01); *B03C 3/025* (2013.01); *B03C 3/09* (2013.01);
(Continued)

(58) Field of Classification Search
CPC ..... B02C 19/18; B02C 23/10; B03C 3/025; B03C 3/155; B03C 3/09; C22B 1/00
(Continued)

(56) References Cited

U.S. PATENT DOCUMENTS 1,947,035 A 2/1934 Covington
2,300,324 A * 10/1942 Thompson ..... B03C 7/00 209/127.1
(Continued)

FOREIGN PATENT DOCUMENTS

AU 2013209367 B2 2/2015
CN 104984807 A * 10/2015 ..... B02C 19/18
(Continued)

OTHER PUBLICATIONS

Zuo, Weiran, et al., "Pre-concentration of copper ores by high voltage pulses. Part 1: Principle and major findings", Minerals Engineering, vol. 79, 2015, pp. 306-314.
(Continued)

*Primary Examiner* — Patrick H Mackey
(74) *Attorney, Agent, or Firm* — Nixon & Vanderhye P.C.

(57) ABSTRACT

The invention provides an integrated separator system for the preconcentration of a material comprising one or more grizzly bars and one or more electrodes which provide a high voltage pulse (HVP) discharge to the material. The invention also provides a process for preconcentration of a material preferably a mineral within a rock which comprises: providing the material into an integrated separator system comprising one or more grizzly bars and one or more electrodes which are capable of providing at least one high voltage pulse discharge(s) to the material; applying one or more high voltage pulse discharge(s) to the material as the material is travelling along the grizzly bar(s) to preferentially disintegrate the particles containing mineral grains of
(Continued)

100 high conductivity/permittivity; separating the disintegrated particles by way of the grizzly bar(s) resulting in the separation of the feed material into low grade (oversize) and high grade (undersize) products; and wherein the disintegrated particles from step b) pass through a screening element for further treatment. The present invention also relates to a process for comminution of a material.

10 Claims, 3 Drawing Sheets

(51) Int. Cl.

| | |
|---|---|
| ***C22B 1/00*** | (2006.01) |
| ***B03C 3/02*** | (2006.01) |
| ***B03C 3/09*** | (2006.01) |
| ***B03C 3/155*** | (2006.01) |

(52) U.S. Cl.
CPC ..... *B03C 3/155* (2013.01); *C22B 1/00* (2013.01); *B02C 2019/183* (2013.01)

(58) Field of Classification Search
USPC ..... 241/1
See application file for complete search history.

(56) References Cited

U.S. PATENT DOCUMENTS

| | | | | |
|---|---|---|---|---|
| 3,460,766 | A | 8/1969 | Sarapuu | |
| 10,029,262 | B2 * | 7/2018 | Ahlqvist Jeanneret | B02C 23/06 |
| 2021/0094043 | A1 * | 4/2021 | Yuan | B02C 23/16 |

FOREIGN PATENT DOCUMENTS

| | | | | |
|---|---|---|---|---|
| CN | 106552704 A | | 4/2017 | |
| CN | 106824454 A | | 6/2017 | |
| CN | 106824455 A | | 6/2017 | |
| CN | 106944223 A | * | 7/2017 | B02C 19/18 |
| JP | 09-92526 | | 7/1997 | |
| JP | H09-192526 A | | 7/1997 | |
| WO | 1999/003588 | | 1/1999 | |
| WO | WO-9903588 A1 | * | 1/1999 | B02C 19/18 |

OTHER PUBLICATIONS

Shi, Fengnian, et al., "Pre-concentration of copper ores by high voltage pulses. Part 2: Opportunities and challenges", Minerals Engineering, vol. 79, 2015, pp. 315-323.
International Search Report for PCT/AU2018/000099 dated Sep. 6, 2018, 3 pages.
Written Opinion of the IPEA for PCT/AU2018/000099 dated May 22, 2019, 6 pages.
International Preliminary Report on Patentability for PCT/AU2018/000099 dated Oct. 17, 2019, 7 pages.
Extended European Search Report dated Jan. 20, 2021, issued in European Patent Application No. 18820685.8, 6 pages.
Office Action dated Dec. 14, 2021, issued in Chile Patent Application No. 201903761, 4 pages.
Office Action dated Mar. 3, 2022, issued in China Patent Application No. 201880052259.7, 9 pages.

* cited by examiner

INTEGRATED SEPARATOR SYSTEM AND PROCESS FOR PRECONCENTRATION AND PRETREATMENT OF A MATERIAL

This application is the U.S. national phase of International Application No. PCT/AU2018/000099 filed Jun. 21, 2018 which designated the U.S. and claims priority to AU Patent Application No. 2017204211 filed Jun. 21, 2017, the entire contents of each of which are hereby incorporated by reference.

FIELD OF THE INVENTION

The present invention provides an integrated separator system for the preconcentration of a material. In particular, the invention relates to an integrated separator system comprising one or more electrodes used for the preconcentration of a material contained within a host rock. The present invention also provides a process for preconcentration of a material.

The integrated separator system and process of the present invention finds particular application for preconcentration where the material is a mineral in an ore being processed by the mining industry. Specific reference will be made to this application hereafter. However, it should be understood by the skilled person that the invention may find broader application.

SUMMARY OF THE INVENTION

According to an embodiment of the present invention, there is provided an integrated separator system for the preconcentration of a material comprising one or more grizzly bars and one or more electrodes which provide a high voltage pulse (HVP) discharge to the material.

Preferably, the integrated separator system comprises a screen element comprising a plurality of grizzly bars. The grizzly bars may be arranged in the screen element such that there are alternating positive and negative electrodes which provide the HVP discharge to the material. The grizzly bars may also be arranged in the screen element wherein the grizzly bars/screen element form a negative electrode and the system further comprises a positive electrode located above the grizzly screen element.

According to a further embodiment of the present invention, there is provided a process for preconcentration of a material preferably a mineral within a rock which comprises:

a) providing the material into an integrated separator system comprising one or more grizzly bars and one or more electrodes which are capable of providing at least one high voltage pulse discharge(s) to the material;
b) applying one or more high voltage pulse discharge(s) to the material as the material is travelling along the grizzly bar(s) to preferentially disintegrate the particles containing mineral grains of high conductivity/permittivity;
c) separating the disintegrated particles by way of the grizzly bar(s) resulting in the separation of the feed material into low grade (oversize) and high grade (undersize) products;

and wherein the disintegrated particles from step b) pass through the screening element for further treatment.

The disintegrated particles that pass through the screen are weakened so that they require less energy to break in subsequent breakage processes. The material in the disintegrated particles that pass through the screen are also better liberated with respect to the host rock than if it had been broken using mechanical breakage devices.

In a further embodiment, the material is preferably an ore or a rock containing a valuable conductive metal, present as pure metal or in a mineral matrix. The valuable metal may be selected from the group consisting of gold, copper, silver, nickel, lead, zinc, rutile, tungsten and platinum.

In a further embodiment, the material which is conductive may be a mineral which is considered a contaminant or a gangue species where there would be a benefit if it was removed or decreased in grade from the ore stream. An example is pyrite in a coal matrix or other mineral materials having higher conductivity/permittivity than coal.

In a further embodiment, the feed material is pre-screened and the material in a narrow size fraction is presented to step a). The feed material is preferably in the size range of 100 to 150 mm, 50 to 100 mm, 25 to 50 mm, and 10 to 25 mm. The narrowly sized material is treated in steps b) and c) respectively.

In a further embodiment, the entire Run-of-Mine (RoM) feed is presented to the process in step a), with a gap between the grizzly bars setting at from 50 to 200 mm, 60 to 180 mm, 70 to 160 mm, 80 to 150 mm, 85 to 140 mm, 90 to 130 mm, 95 to 125 mm, 95 to 115 mm, 95 to 105 mm, or about 100 mm. The particles retained on the grizzly screen element will be subjected to the treatment in steps b) and c). The undersize product material will be subjected to the subsequent stages of treatment described in steps a) to c), with a reduced grizzly bar gap until reaching about 10 mm in the final stage of treatment.

The screening step c) preferably separates oversized ore as a low grade material.

This material can be rejected as a waste if the grade is sufficiently low; or diverted to a different metal recovery process such as leaching, if significant metal loss would be associated with the low grade material rejection.

The undersized ore material from the final stage treatment can be crushed and ground using traditional comminution devices and processed in different treatment routes.

According to a further embodiment, the integrated separator grizzly bar system and process can be used as a means of comminution and pre-treatment of the entire feed stream with particles repeatedly subjected to high voltage pulse discharge (HVP) until they are broken and pass through the grizzly bars.

In this embodiment, the feed stream is not separated into low and high grade particles but all particles are broken.

In this application, the particles broken by the HVP discharge are pre-weakened which reduces energy use in subsequent comminution processes. The minerals in the fragments produced after breakage by the HVP discharge are better liberated from the host rock and this improves the efficiency of downstream separation processes. This improved liberation is also observed in particles after additional mechanical breakage. It is envisaged that this application will mostly be used when the high conductivity/permittivity minerals are homogeneously distributed in the feed particles and preconcentration is not economically viable.

Definitions

The following part of the specification provides some definitions that may be useful in understanding the description of the present invention. These are intended as general definitions and should in no way limit the scope of the present invention to those terms alone, but are put forth for a better understanding of the following description.

Unless the context requires otherwise or it is specifically stated to the contrary, integers, steps, or elements of the invention recited herein as singular integers, steps or elements clearly encompass both singular and plural forms of the recited integers, steps or elements.

Throughout this specification, unless the context requires otherwise, the word "comprise", or variations such as "comprises" or "comprising", will be understood to imply the inclusion of a stated step or element or integer or group of steps or elements or integers, but not the exclusion of any other step or element or integer or group of elements or integers. Thus, in the context of this specification, the term "comprising" is used in an inclusive sense and thus should be understood as meaning "including principally, but not necessarily solely".

Throughout the specification, unless the context indicates otherwise, the terms "material" or "materials" are taken to mean any brittle or semi-brittle material or fragments thereof, including but not limited to metals, ores, rocks, concrete, cement, composite materials, rigid plastics and polymeric material and the like. Preferably the "material" or "materials" include ores, rocks, concrete, cement, or composite materials and fragments thereof.

As used herein, the term "comminution" includes any reduction in particle size of the material. The term is not intended to be limited to pulverisation and may include any degree of reduction in particle size. Likewise, the term "comminuting" as used herein includes within its scope any crushing or milling operation used to reduce the particle size of the material. The term also includes alternative operations that are not necessarily mechanical for the reduction of particle size including, but not limited to, the application of high voltage electrical pulse energy, to fracture the material thereby reducing particle size.

As used herein, the term "disintegration" includes any breakage or complete fracture of the particulate material.

The high voltage pulse discharge(s) used in the invention may be applied at a specific energy sufficient to disintegrate the material preferably at grain boundaries within the material. Ideally, a minimum amount of energy is employed that will disintegrate a particle that contains high conductivity/permittivity minerals, but not to disintegrate a particle that contains less amounts of the high conductivity/permittivity minerals.

It is envisaged that the high voltage pulse discharge(s) may have a specific energy from 0.5 kWh/t to 10 kWh/t, preferably from 1 kWh/t to 8 kWh/t, 1 kWh/t to 7 kWh/t, 1 kWh/t to 6 kWh/t, 1 kWh/t to 5 kWh/t, more preferably from 2 kWh/t to 5 kWh/t to disintegrate particles ranging from 10 mm to 150 mm.

For a given particle size and mass, the high voltage pulse specific energy can be controlled by varying voltage and capacitance in the generator system, and by varying the number of pulses. It is envisaged that the high voltage pulse discharge can have a voltage from 20 kV to 400 kV, preferably from 40 kV to 350 kV, from 60 kV to 300 kV, from 80 kV to 250 kV, from 90 kV to 225 kV, from 95 kV to 210 kV, from 95 kV to 200 kV, from 100 kV to 195 kV, more preferably from 100 kV to 190 kV, 110 kV to 185 kV, 120 kV to 180 kV fora given capacitor from 20 nF to 600 nF.

It is also envisaged that the high voltage pulse discharge(s) will include the application of from 1 to 100 pulses, 1 to 90 pulses, 1 to 80 pulses, 1 to 70 pulses, 1 to 60 pulses, 1 to 50 pulses, 1 to 40 pulses, 1 to 30 pulses, 1 to 20 pulses, 1 to 15 pulses, 1 to 12 pulses, or 1 to 10 pulses. In another embodiment, the high voltage pulse discharge may include the application of a single pulse discharge.

Whilst it is envisaged that the high voltage discharge may be directly applied to the material, this is not always the case. Rather, the high voltage discharge may also be applied to the material when submerged in a dielectric liquid, such as water, oil or other organic liquid. Preferably, the dielectric liquid may be water.

As mentioned above, the step of comminuting the material prior to or subsequent to the application of the high voltage pulse discharge(s) is not particularly limited. This may include, but is not necessarily limited to, a mechanical comminution step. For example, the step of comminuting the material may include a crushing or milling operation.

In a further embodiment, step b) of the process may be conducted on an integrated grizzly screen which comprises a plurality of grizzly bars and the high voltage pulse generation system, where each grizzly bar of the grizzly screen acts as an electrode, with preferably positive and negative electrodes in an alternative arrangement or other arrangements as would be understood by the skilled person.

In a further embodiment of the integrated separator system, the system comprises a plurality of grizzly bars which form a grizzly screen or grizzly screen element. The grizzly screen may comprise a plurality of grizzly bars and a high voltage pulse generation system, where each grizzly bar of the grizzly screen may act as an electrode, with preferably positive and negative electrodes in an alternative arrangement.

In a further embodiment, the integrated separator system or the process for preconcentration of a material may be used to remove sulphide minerals such as pyrite or other mineral matters having higher conductivity/permittivity than coal to improve coal quality and to reduce environmental impact The grizzly screen element allows the disintegrated particles to pass through to the undersize product whilst the non-disintegrated particles are retained on top of the grizzly screen/bars as the oversize product.

In another embodiment, step b) of the process can also be conducted using the integrated grizzly screen and the high voltage pulse discharge system with a different electrode arrangement, where the grizzly bars act as the negative electrode, and the positive electrode bars are located above the grizzly bars.

In a further embodiment of the integrated separator system, the integrated grizzly screen and the high voltage pulse discharge system are arranged such that the grizzly bars act as the negative electrode, and positive electrode bars are located above the grizzly bars.

The feed material moves along the grizzly bars directly underneath the positive electrodes and is subjected to high voltage pulse loading while travelling along the grizzly bars. The disintegrated particles pass through the gap between the grizzly bars as the undersize product; and the non-disintegrated particles are retained on top of the grizzly bars as the oversize product.

The surface of the grizzly screen may be inclined towards the discharge end to allow the feed material to travel along the inclined grizzly bars due to gravity. The angle of inclination is preferred from 5 to 50 degrees, 10 to 40 degrees, or more preferably from 20 to 30 degrees.

The grizzly bars in the integrated separator system or in the process may also be moved backwards and forwards by a motorised system to facilitate movement along the grizzly screen. The grizzly bars may also be rectangular or cylindrical in cross-sectional shape. The grizzly bars may also be parallel to each other or arranged in a cone shape with a first end of the grizzly bars having a large gap therebetween than compared to a second end of the respective grizzly bars.

DETAILED DESCRIPTION OF THE INVENTION

The invention will now be described, by way of example only, and with reference to the accompanying figures. It will be appreciated that the figures are provided for illustration of the invention only and should not be construed as limiting the generality and scope of the invention as provided by the claims.

FIG. 1 illustrates the integrated high voltage pulse discharge and the grizzly screen separator system (100) and process for preconcentration of an ore material.

Figure 1:
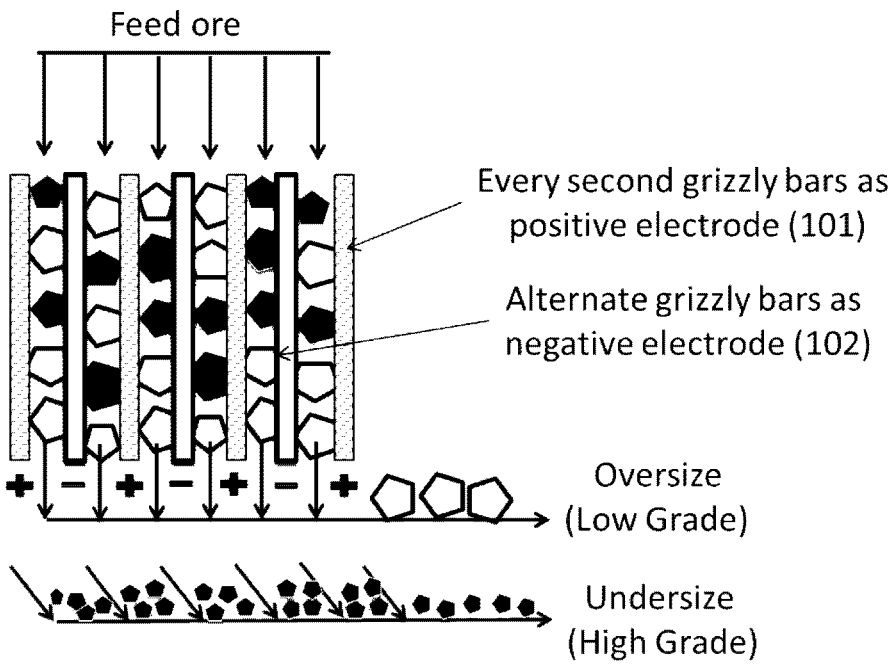
FIG. 1 shows a top view of the integrated high voltage pulse discharge separator system with the grizzly screen which is used to disintegrate the high grade ore particles and to separate the high grade and the low grade ore particles by size according to a first preferred embodiment of the invention.

The integrated separator system (100) combines the high voltage pulse discharge and screen separation functions in a grizzly screen which comprises a plurality of grizzly bars (101 & 102). Each grizzly bar acts as an electrode, with every second grizzly bar acting as a positive electrode (101) and the alternate grizzly bars acting as negative electrodes (102).

Ore particles in a given size fraction are fed onto the top of the grizzly screen. The grizzly bars in the grizzly screen are arranged with a predetermined gap to be able to retain the ore particles in the given feed size. The grizzly bars/screen operates with an inclined angle to allow ore particles to travel along the bars due to gravity. High voltage pulses are discharged in the vicinity of the grizzly bars 101 or 102 in a controlled frequency to create a horizontal pulse discharge zone between the positive electrode (101) and the negative electrode (102) while the ore particles are travelling along the grizzly bars/screen.

Particles containing a high grade of conductivity/permittivity minerals (shown as the black solid particles in FIG. 1) will attract the pulse discharge energy and will be preferentially disintegrated by plasma channel expansion through the body of the ore particles. Particles that do not contain high grades of conductivity/permittivity minerals (shown as the white particles in FIG. 1) will be "protected" by those containing high conductivity/permittivity minerals and will not be broken while both particles travel through the high voltage pulse discharge zone.

The disintegrated higher grade particles will drop through the grizzly bars and be collected as an undersized product; while particles with low grade or barren rocks will not be broken by the pulses, and will be retained on top of the grizzly bars and discharge at the end of the grizzly as an oversize product.

Thus the feed ore when passing through this integrated separator system will be split by grade. The bar length, inclined angle, pulse charge frequency, pulse energy can be designed to effectively split feed ore by grade.

Figure 2:
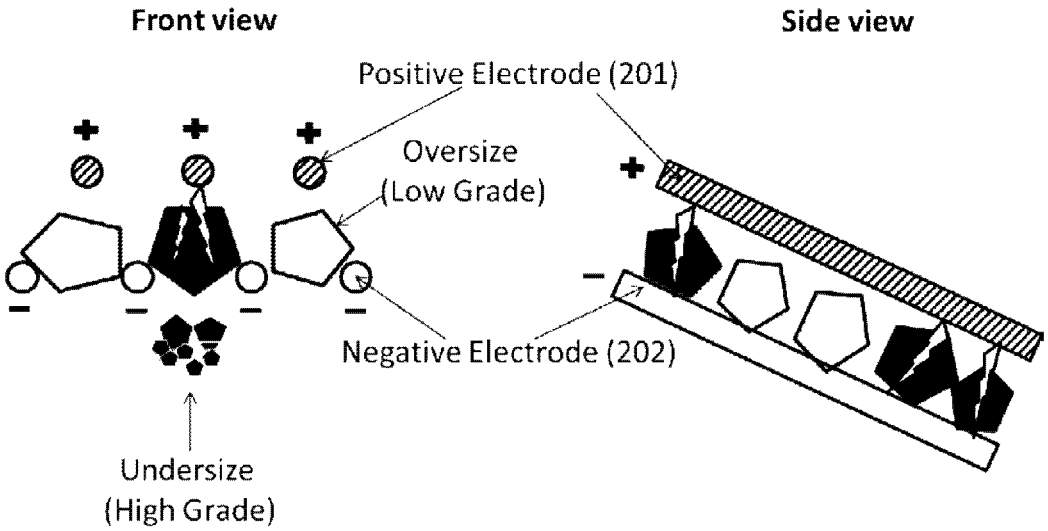
FIG. 2 shows an expanded front and side view of a pair of grizzly bars which act as electrodes in the integrated high voltage pulse discharge separator system with the grizzly screen which is used to disintegrate the high grade ore particles and to separate the high grade and the low grade ore particles by size according to a second preferred embodiment of the invention.

FIG. 2 demonstrates a further preferred embodiment of the integrated separator system and also of the process of the present invention for the step of applying one or more high voltage pulse discharge(s) to feed ore particles in the integrated high voltage pulse discharge and the grizzly screen system. In this preferred embodiment, the whole grizzly screen comprising a plurality of grizzly bars is used as the negative electrode (202), while the positive electrode (201) is located above the grizzly screen/bars. The gap between the plurality of grizzly bars (202) and the distance between the electrodes (from 201 to 202) are arranged to retain the feed ore particles on the grizzly and allow free movement of the feed ore particles between the electrodes 201 and 202 in accordance with the feed ore size range. When ore particles move along the inclined grizzly bars (202) and pass through the vertical high voltage pulse discharge zone, the high grade ore particles will preferentially attract the pulse discharge energy and be disintegrated. The broken fragments will drop through the gap of the grizzly bars (202) and be collected as an undersized product. The low grade ore or the barren rocks will pass the pulse discharge zone without substantial body disintegration. These low grade feed particles will be retained on the top of the grizzly bars and become the oversize product.

When a plurality of ore particles are presented to the high voltage pulse discharge field, the spark energy selectively goes through those ore particles containing high conductivity/permittivity minerals and breaks these ore particles into small fragments. While barren or low grade rocks that contain less high conductivity/permittivity minerals will not receive the same level of spark energy and they are "protected" by the particles containing high conductivity/permittivity minerals and are hence not broken. Therefore in the multi-particle treatment applications such as illustrated in FIGS. 1 and 2, the spark energy is used more efficiently as it preferentially breaks metal-bearing particles.

It should be understood that the ore particles shown in FIG. 2 containing a high grade of conductivity/permittivity minerals are shown as the black solid particles in FIG. 2. These ore will attract the pulse discharge energy and will be preferentially disintegrated by plasma channel expansion through the body of the ore particles.

Particles that do not contain high grades of conductivity/permittivity minerals are shown as the white particles in FIG. 2 which will be "protected" by those containing high conductivity/permittivity minerals and will not be broken while both particles travel through the high voltage pulse discharge zone.

Example

In a particular example of the present invention, the following was performed using an Australian copper ore, approximately 14 particles per batch in a size range of 19 to 26.5 mm which were treated in a high voltage pulse processing system. 15 batches of tests, treating 3.8 kg of particles in total, were repeated to increase statistical confidence. A total of 3.8 kWh/t specific spark energy was used in the process. The pulses selectively disintegrated some particles, whilst others were left intact. The product was sized and assayed.

A yield of 25% feed particles by mass was retained on the parent 19 mm size, which was assayed to contain 0.15% copper. While the copper grade of the undersize product was 0.37%.

In this example, the high voltage pulse treatment followed by size based separation effectively split the feed ore into low grade and high grade products.

Figure 3:
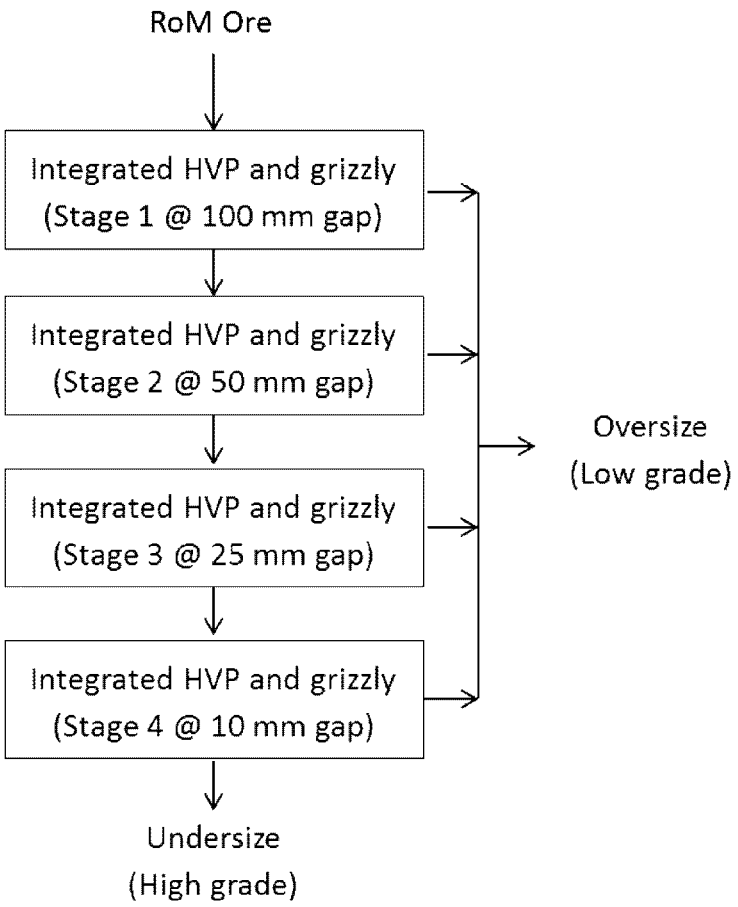
FIG. 3 is a schematic view of a third preferred embodiment of the invention which provides an example of multi-stage treatment of RoM ore using the integrated separator system and process of the present invention which does not require the RoM ore to be pre-screened.

FIG. 3 illustrates a schematic flowsheet using the process of the present invention to treat the entire RoM feed ore without the pre-screening requirement. The process is undertaken in multiple stages of treatment using the process and integrated separator system of the present invention.

In a first treatment stage, the gap between grizzly bars is set at 100 mm. Material smaller than 100 mm from the RoM ore will drop to the screen undersize. Material retained on the set of grizzly bars will be subjected to high voltage pulse treatment. Those particles that remain intact or remain on the top of the grizzly screen after passing through the pulse discharge field will be discharged as an oversize product. The undersize product material will then be subjected to a second treatment stage, with a grizzly bar gap set at 50 mm. The process repeats for a third stage at 25 mm grizzly bar gap, and for a fourth and final stage at a 10 mm grizzly bar gap.

The grizzly bar/electrode configuration as described above and as shown in FIG. 1 can be used in the first two stages with a gap setting larger than or equal to 50 mm. The grizzly bar/electrode configuration as described above and as shown in FIG. 2 can be used in the last two stages with a gap setting smaller than 50 mm.

The integrated ore grade splitting system as shown in FIGS. 1 and 2 has a large throughput capacity and a small floor space, and can be operated in a continuous mode. The system can be designed in multiple layers for the flowsheet application as presented in FIG. 3. In this arrangement, the undersize product from the top grizzly drops to the next layer of grizzly that has a smaller gap between the grizzly bars.

The RoM ore can contain metal scats from the mining process. The metal scats may have a tendency to affect the high voltage pulse efficiency in the preconcentration process. If this happens, a metal detector and a metal removal facility can effectively remove the metal scats prior to the high voltage pulse treatment.

The advantages of the invention are:

Preconcentration of ore grade to enhance metal recovery in flotation or downstream separation;

Increased circuit capacity since 20 to 30% of the ore feed can be rejected from the process by the invention;

Reduce the tonnage and therefore the costs of ore haulage by using the invention underground or in pit where the ore is mined and rejecting waste at an early stage;

Increase viable ore resources by using the invention to reject waste and reduce the mining cut-off grade.

Particles in the screen undersize product which have been broken by the HVP discharge are weakened (compared to the feed) due to the generation of cracks/microcracks by the high voltage pulse energy. This will reduce the energy consumption in the downstream comminution processes.

The screen undersize product which has been broken by the high voltage pulse discharge contains particles with better liberation of the high conductivity/permittivity minerals than achieved when mechanically breaking the particles. This is caused by preferential breakage around boundaries of different minerals when broken by high voltage pulses. This will enable better concentrate grades and recovery in the downstream separation processes. This improved liberation is also observed in particles after additional mechanical breakage.

It will of course be realised that the above has been given only by way of illustrative example of the invention and that all such modifications and variations thereto as would be apparent to those of skill in the art are deemed to fall within the broad scope and ambit of the invention as herein set forth.

The claims defining the invention are as follows:

1. An integrated separator system for the preconcentration of a material, the system comprising a grizzly screen having a plurality of grizzly bars, and spacing between bars of the plurality of grizzly bars allows disintegrated particles of the material to pass through the grizzly screen while non-disintegrated particles are retained on top of the grizzly screen;

wherein the grizzly bars act as electrodes which provide a high voltage pulse (HVP) discharge to the material;

wherein the HVP discharge is applied at a voltage and energy sufficient to disintegrate particles of the material containing high conductivity or high permittivity minerals; and wherein particles that do not contain high conductivity or high permittivity minerals are protected by particles containing high conductivity or high permittivity minerals and are not broken.

2. The separator system of claim 1, wherein the grizzly screen comprises grizzly bars which act as alternating positive and negative electrodes of a screen element.

3. The separator system of claim 1, wherein the grizzly screen acts as a negative electrode and a positive electrode is located above the grizzly screen.

4. The separator system of claim 1, wherein the grizzly bars are cylindrical or rectangular in cross-sectional shape.

5. The separator system of claim 1, wherein a gap between the grizzly bars is set between 10 to 200 mm.

6. The separator system of claim 1, wherein the grizzly bars are rectangular in cross sectional shape and are substantially parallel to each other.

7. The separator system of claim 1, wherein the grizzly bars are rectangular in cross sectional shape and are arranged in a cone shape with a first end of the grizzly bars having a larger gap therebetween than compared to a second end of the respective grizzly bars.

8. The integrated separator system according to claim 1, wherein the system is used to remove sulphide minerals selected from the group comprising pyrite or other mineral matters having higher conductivity/permittivity than coal to improve coal quality and to reduce environmental impact.

9. A process for preconcentration of a material preferably a mineral which comprises:

a) providing the material into an integrated separator system comprising one or more grizzly bars and one or more electrodes which are capable of providing at least one high voltage pulse discharge(s) to the material;

b) applying one or more high voltage pulse discharge(s) to the material as the material is travelling along the grizzly bar(s) to preferentially disintegrate the particles containing mineral grains of high conductivity/permittivity;

c) separating the disintegrated particles by way of the grizzly bar(s) resulting in the separation of the feed material into low grade (oversize) and high grade (undersize) products;

and wherein the disintegrated particles from step b) pass through a screening element for further treatment.

10. A process for preconcentration of a material according to claim 9, wherein the material is a mineral within a rock.

* * * * *